US008845381B2

(12) United States Patent
Ziegler

(10) Patent No.: US 8,845,381 B2
(45) Date of Patent: Sep. 30, 2014

(54) GEOMETRIC CONSTRUCTION MODULE AND SYSTEM

(75) Inventor: James T. Ziegler, Burlington (CA)

(73) Assignee: Novation Design Inc., Burlington, Ontario (CA)

( * ) Notice: Subject to any disclaimer, the term of this patent is extended or adjusted under 35 U.S.C. 154(b) by 297 days.

(21) Appl. No.: 13/477,434

(22) Filed: May 22, 2012

(65) Prior Publication Data

US 2012/0270463 A1 Oct. 25, 2012

Related U.S. Application Data

(63) Continuation-in-part of application No. 29/404,151, filed on Oct. 17, 2011.

(30) Foreign Application Priority Data

Apr. 21, 2011 (CA) ..... 140269
May 30, 2011 (CA) ..... 2741284

(51) Int. Cl.
*A63H 33/08* (2006.01)

(52) U.S. Cl.
CPC ..... *A63H 33/08* (2013.01)
USPC ..... 446/108

(58) Field of Classification Search
USPC ..... 446/85, 105, 106, 107, 108, 109, 112, 446/113, 114, 115, 122, 124, 125; 434/81, 434/96, 97
See application file for complete search history.

(56) References Cited

U.S. PATENT DOCUMENTS

| | | | | |
|---|---|---|---|---|
| 3,562,077 | A * | 2/1971 | Raba | 428/12 |
| 3,666,607 | A * | 5/1972 | Weissman | 428/33 |
| 4,874,341 | A * | 10/1989 | Ziegler | 446/109 |
| 4,976,652 | A | 12/1990 | Schwartz | |
| 5,368,301 | A | 11/1994 | Mitchell | |
| 5,400,918 | A * | 3/1995 | Prodaniuk | 220/677 |
| 5,895,045 | A | 4/1999 | Vilar | |
| 5,895,306 | A * | 4/1999 | Cunningham | 446/108 |
| 6,142,848 | A * | 11/2000 | Madner et al. | 446/115 |
| 6,179,681 | B1 * | 1/2001 | Matos | 446/116 |
| 6,684,591 | B2 * | 2/2004 | Jean | 52/589.1 |
| 7,438,623 | B2 * | 10/2008 | Lin | 446/108 |
| 7,640,775 | B2 * | 1/2010 | Durney | 72/324 |
| 7,833,077 | B1 | 11/2010 | Simmons, Jr. | |
| D645,912 | S * | 9/2011 | Hardstaff | D21/502 |
| 2005/0014441 | A1 | 1/2005 | Matos | |
| 2005/0287906 | A1 | 12/2005 | He | |

FOREIGN PATENT DOCUMENTS

| | | |
|---|---|---|
| CA | 2 214 697 | 6/1998 |
| CA | 140269 | 4/2012 |
| EP | 0 427 523 A2 | 5/1991 |
| GB | 1 222 549 | 2/1991 |
| WO | WO 98/23347 | 6/1998 |

* cited by examiner

*Primary Examiner* — Kurt Fernstrom
(74) *Attorney, Agent, or Firm* — Flynn, Thiel, Boutell & Tanis, P.C.

(57) ABSTRACT

A geometric construction module formed from a substantially flat, flexible material, the module comprising a polygon based shape having two straight edges; and a locking tab pair integral with each one of the straight edges to form joining edges, each locking tab of the locking tab pair having a notch at the straight edge, the notches of each locking tab pair being symmetrical about a center line of the joining edge. Multiple construction modules can be releasably attached at the joining edges to form models.

16 Claims, 29 Drawing Sheets

GEOMETRIC CONSTRUCTION MODULE AND SYSTEM

CROSS-REFERENCE TO RELATED APPLICATIONS

This is a continuation-in-part of co-pending U.S. patent application Ser. No. 29/404,151, filed Oct. 17, 2011 the disclosure of which is hereby incorporated by reference in its entirety.

FIELD OF THE DISCLOSURE

Described embodiments relate to the field of geometric construction modules and systems capable of producing three-dimensional constructions such as for use in toy construction sets, educational modeling tools and advertising/point-of-sale displays.

BACKGROUND

Conventional geometric construction modules and systems involving joining reconnectable modules together have difficulty in retaining a connection when joined modules are bent out of plane of an assembly other than by marginal friction typically created between two modules. A need therefore arises for a geometric construction module and system capable of supporting both planar and voluminous forms such as polyhedral constructions.

SUMMARY

Certain exemplary embodiments can provide a geometric construction module formed from a substantially flat, flexible material, the module comprising: a polygon based shape having two straight edges; and a locking tab pair integral with each one of the straight edges to form joining edges, each locking tab of the locking tab pair having a notch at the straight edge, the notches of each locking tab pair being symmetrical about a center line of the joining edge.

Certain exemplary embodiments can provide a geometric construction system comprising a plurality of substantially flat, flexible modules, each module comprising: a polygon based shape having at least two straight edges, at least two curved edges and a center void for providing a bending axis in respect of a plane of the module; and a locking tab pair at each of the straight edges to form joining edges, one of the locking tab pairs of a first module from the plurality of modules being releasably engageable with one of the locking tab pairs of a second module from the plurality of modules to establish a flexible hinge imparting planar stiffening between the joined first and second modules for enabling construction of a model having compound curves.

Certain exemplary embodiments can provide a geometric construction system comprising a plurality of substantially flat and flexible modules formed from a polygon group consisting of at least two of triangle, quadrilateral, pentagon, hexagon and octagon, each module in the polygon group having at least two straight edges with each straight edge being the same length; each straight edge having two spaced apart locking tabs with each locking tab having a notch for releasably engaging locking tabs from another module in the polygon group to form a flexible hinge, wherein groups of the plurality of modules are interconnectable through respective locking tabs to enable the formation of a three-dimensional structure.

DETAILED DESCRIPTION

Figure 1:
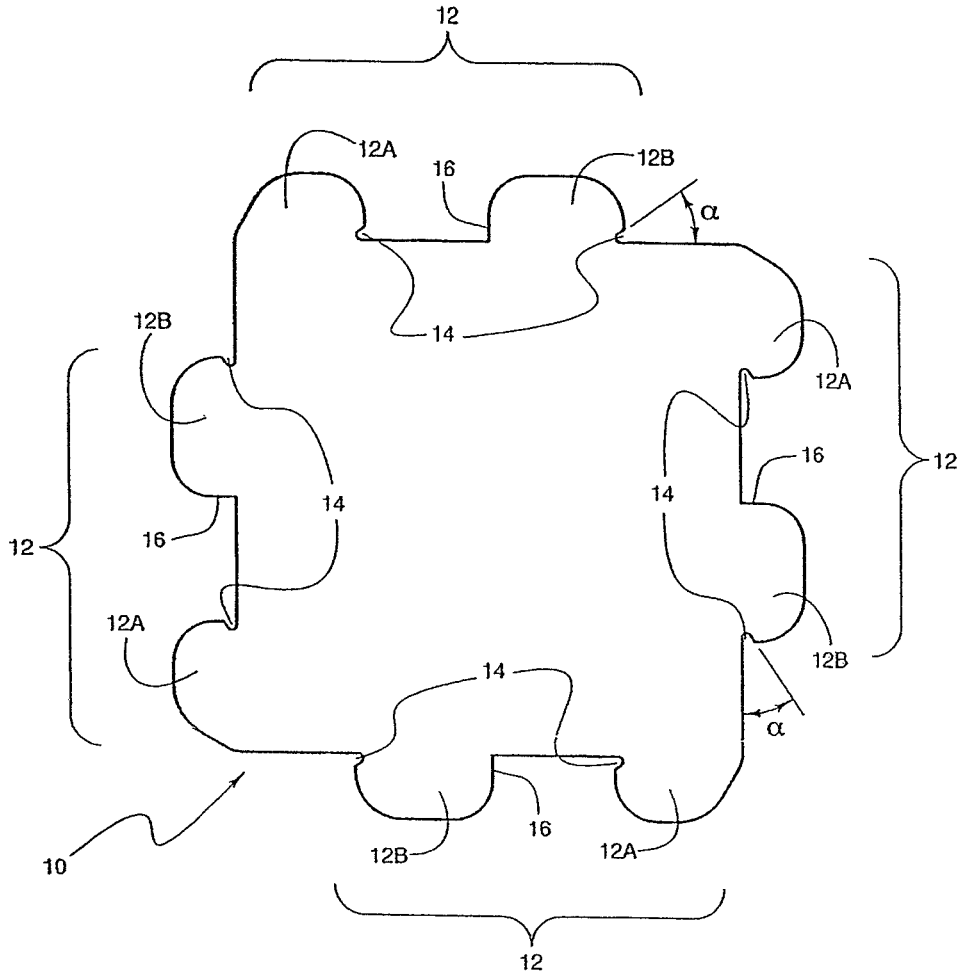
FIG. 1 illustrates a quadrilateral based geometric construction module according to an embodiment.

Construction Module—FIG. 1

Figure 29A:
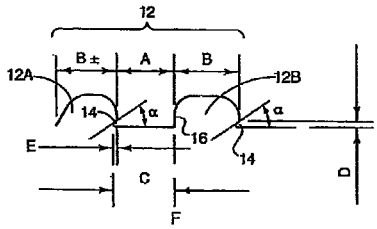
FIGS. 29A to 29C illustrate locking tab pair geometry for construction modules according to various embodiments.
Figure 29B:
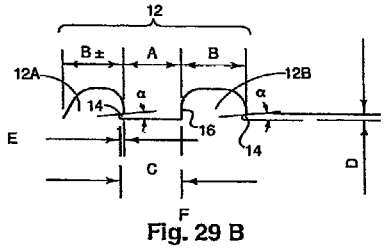

FIG. 1 shows a plan view of a geometric construction module 10 according to one embodiment. The module 10 is substantially flat and flexible and has a polygon based shape (i.e., module 10 is based on a quadrilateral/square). The module 10 has four equal length straight edges with each straight edge having a locking tab pair 12 to form a joining edge. A straight edge having a locking tab pair 12 is termed a joining edge. It is possible to have a straight edge that is not a joining edge (see for example module 36 of FIG. 6). The locking tab pair 12 includes two spaced apart locking tabs 12A and 12B that are arranged generally symmetrically about the center line of a joining edge. Each locking tab 12A and 12B includes a notch 14 at the joining edge having a prescribed notch angle $\alpha$. The locking tab 12B includes a straight portion 16 that is perpendicular to the joining edge and is opposite to the notch 14 of the locking tab 12A. (FIGS. 29A and 29B provide further geometric details of the locking tab pair 12).

Generally stated, two modules are releasably connected to each other at the joining edge through the structural interference of engaged pairs of locking tabs. Engaged locking tab pairs produce (a) a flexible hinge with a wide operating range and (b) establish planar stiffening in a direction of the joined modules to enable the creation of both planar and voluminous forms such as polyhedral constructions having compound curvatures.

Construction Module Examples—FIGS. 2 to 26

FIGS. 2 to 26 illustrate plan views of a plurality of construction modules according to various embodiments as separately described below.

Figure 2:
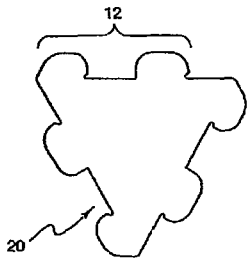
FIGS. 2 to 6 illustrate 3-sided (triangular based) construction modules according to various embodiments.

FIG. 2 shows a triangle based module 20 having three straight edges and where each straight edge includes the locking tab pair 12 to form three joining edges.

Figure 3:
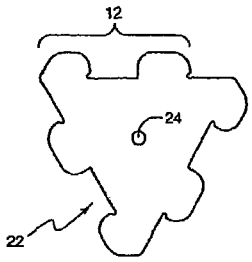

FIG. 3 shows a triangle based module 22 having three straight edges and where each straight edge includes the locking tab pair 12 to form three joining edges. A void 24 in the center of the module 22 increases dimensional flexibility.

Figure 4:
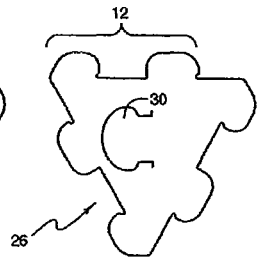

FIG. 4 shows a triangle based module 26 having three straight edges and where each straight edge includes the locking tab pair 12 to form three joining edges. A connecting tab 30 (shown in a flattened orientation) in the center of the module 26 is used for face-to-face connection of modules (as detailed further in FIGS. 36A to 36C).

Figure 5:
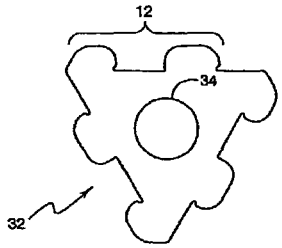

FIG. 5 shows a triangle based module 32 having three straight edges and where each straight edge includes the locking tab pair 12 to form three joining edges. A void 34 (dimensionally larger than void 24 of module 22) in the center of the module 32 increases dimensional flexibility to aid in the construction of complex three-dimensional structures.

Figure 6:
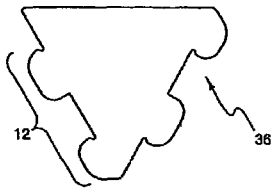

FIG. 6 shows a triangle based module 36 having three straight edges but only two joining edges. In particular, only two of the three straight edges include the locking tab pair 12.

Figure 7:
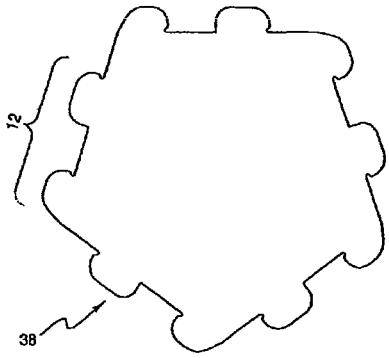
FIGS. 7 and 8 illustrate 5-sided (pentagon based) construction modules according to various embodiments.

FIG. 7 shows a pentagon based module 38 having five straight edges and where each straight edge includes the locking tab pair 12 to form five joining edges.

Figure 8:
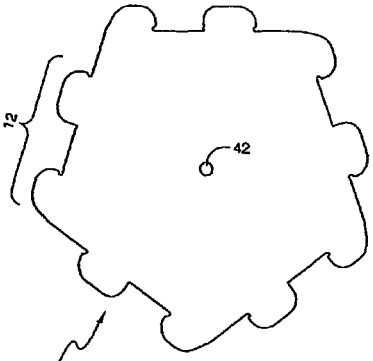

FIG. 8 shows a pentagon based module 40 having five straight edges and where each straight edge includes the locking tab pair 12 to form five joining edges. A void 42 in the center of the module 40 increases dimensional flexibility.

Figure 9:
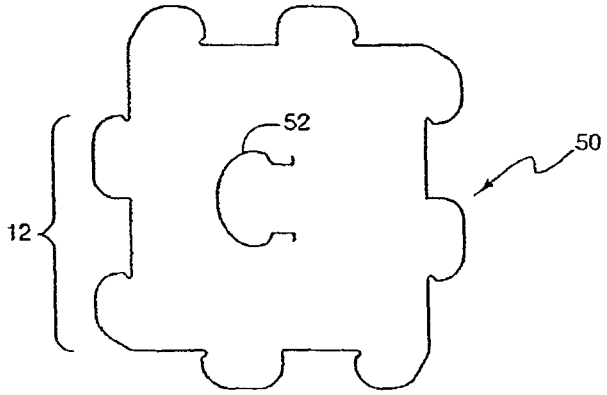
FIGS. 9 to 12 illustrate 4-sided (quadrilateral/square based) construction modules according to various embodiments.
Figure 10:
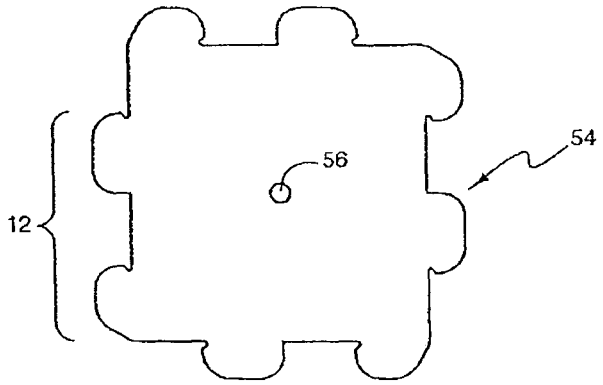
Figure 11:
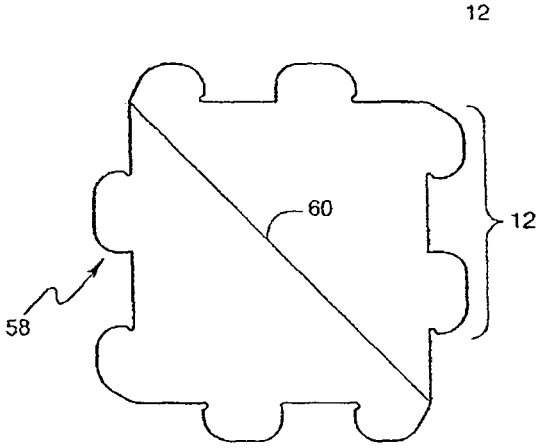
Figure 12:
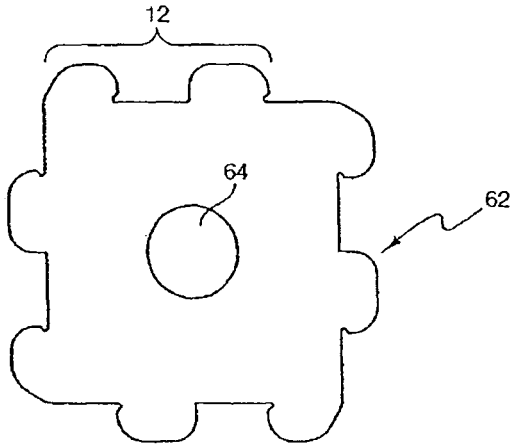

FIGS. 9, 10, 11 and 12 show variants of the quadrilateral/square based module 10 shown in FIG. 1. In particular, a module 50 having a connecting tab 52 is shown in FIG. 9; a module 54 having a center void 56 is shown in FIG. 10; a module 58 having a straight diagonal crease-line (to aid in bending the module 58) is shown in FIG. 11; and a module 62 having a void 64 (to aid in dimensional flexibility of the module 62) is shown in FIG. 12.

Figure 13:
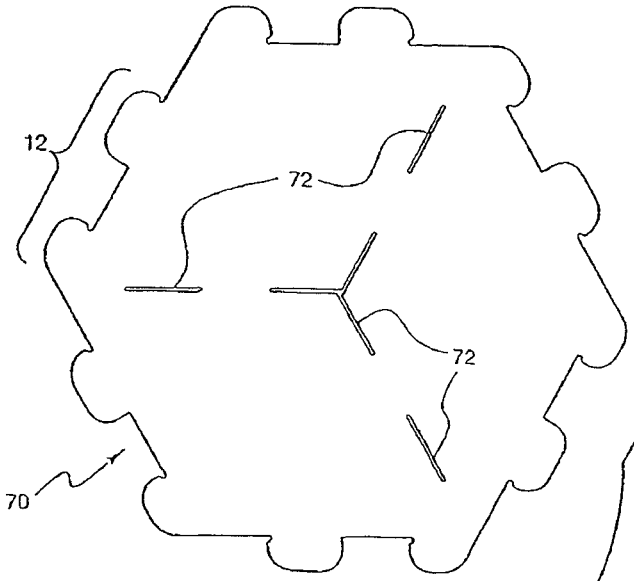
FIG. 13 illustrates a slotted 6-sided (hexagon based) construction module according to an embodiment.

FIG. 13 shows a hexagon based module 70 having six straight edges and where each straight edge includes the locking tab pair 12 to form six joining edges. A plurality of slots 72 are arranged on the module 70 to enable surface mounting of other modules (refer to FIGS. 37A to 37D).

Figure 14:
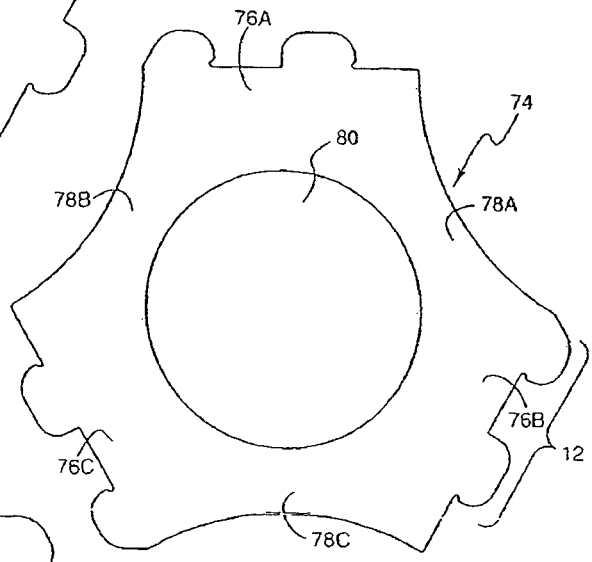
FIG. 14 illustrates a truncated hexagon based construction module according to an embodiment.

FIG. 14 shows a truncated hexagon based module 74 having three straight edges 76A, 76B and 76C and three curved edges 78A, 78B and 78C. Each of the straight edges 76A-C includes the locking tab pair 12 to form three joining edges. A large void 80 provides the module 74 with significant planar flexibility to enable the module 74 to bend along three axes (as detail further in FIGS. 39A to 39D).

Figure 15:
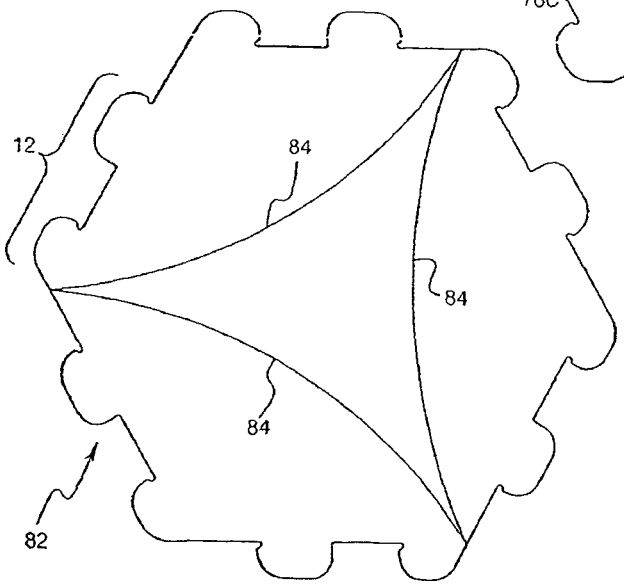
FIG. 15 illustrates a hexagon based construction module with crease-lines according to an embodiment.

FIG. 15 shows a hexagon based module 82 having six straight edges and where each straight edge includes the locking tab pair 12 to form six joining edges. A plurality of curved crease-lines 84 are arranged on the module 82 to aid in bending of the module 82 to enable construction of three-dimensional models (see FIGS. 45A-C for example).

Figure 16:
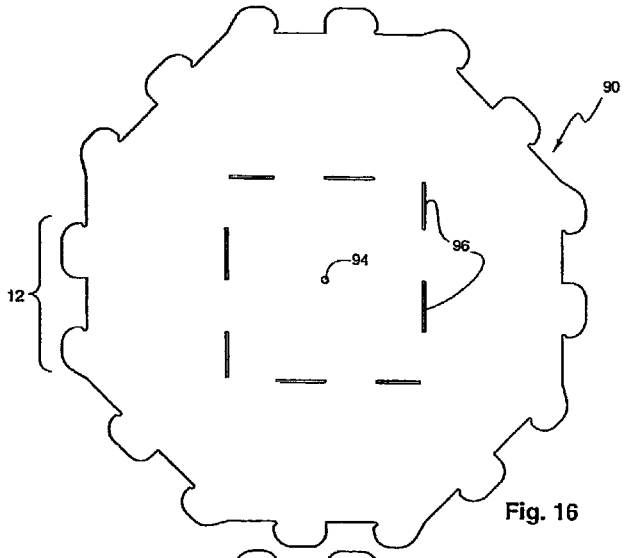
FIG. 16 illustrates a slotted 8-sided (octagon based) construction module having a center void according to an embodiment.
Figure 17:
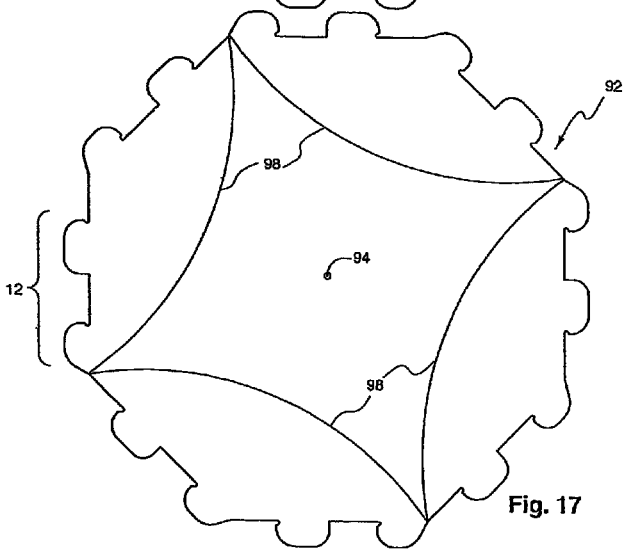
FIG. 17 illustrates an octagon based construction module having a center void and crease-lines according to an embodiment.
Figure 18:
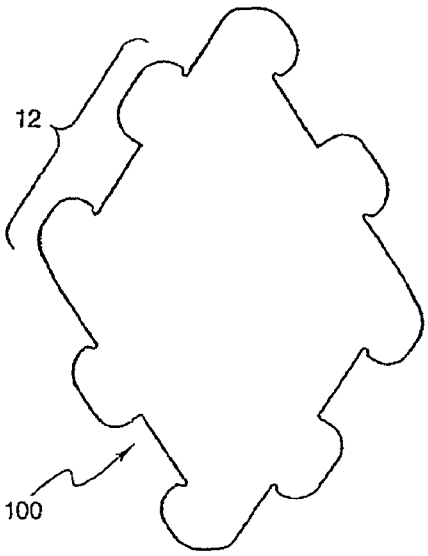
FIGS. 18 to 21 illustrate 4-sided (quadrilateral/rhombus based) construction modules according to various embodiments.
Figure 19:
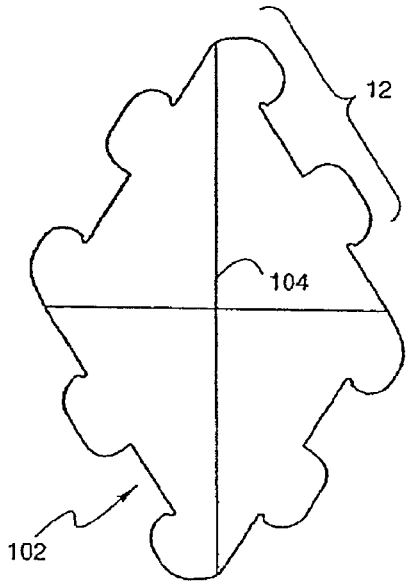
Figure 20:
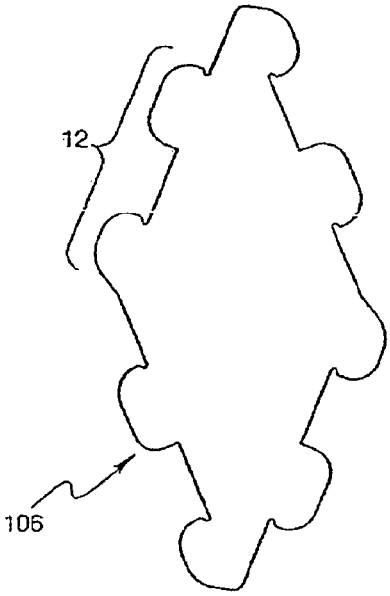
Figure 21:
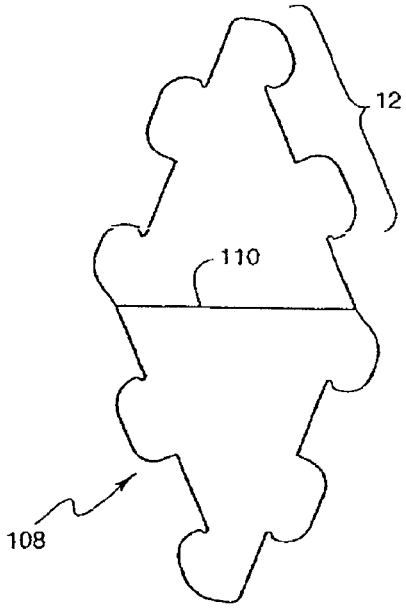

FIGS. 16 and 17 show variants of octagon based modules 90 and 92 with each module 90/92 having eight straight edges and with each edge including the locking tab pair 12 to form eight joining edges. The module 90 also includes a center void 94 and a plurality of slots 96 to enable surface mounting of other modules; and module 92 includes the center void 94 and a plurality of curved crease-lines 98 arranged on the module 92 to aid in bending of the module 92 to enable the construction of three-dimensional models.

FIGS. 18 to 21 show various quadrilateral/rhombus based modules 100, 102, 106 and 108, respectively. Each module 100, 102, 106 and 108 having four straight edges with each straight edge including the locking tab pair 12 to form four joining edges. Modules 102 and 108 include crossing straight crease-lines 104 and a straight crease-line 110, respectively, to aid in bending.

Figure 22:
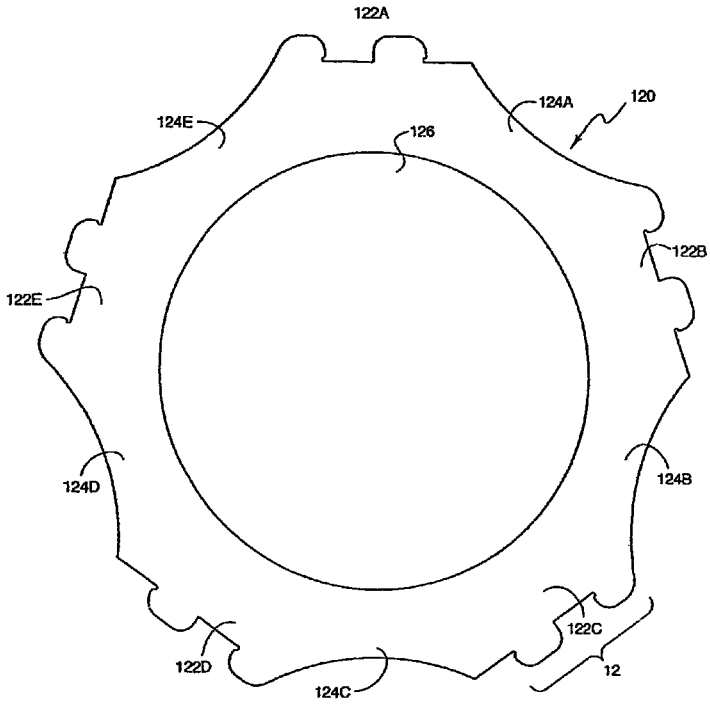
FIG. 22 illustrates a truncated 10-sided (decagon based) construction module according to an embodiment.

FIG. 22 shows a truncated decagon based module 120 having five straight edges 122A to 122E and five curved edges 124A to 124E. Each of the straight edges 122A-E includes the locking tab pair 12 to form five joining edges. A large void 126 provides the module 120 with significant planar flexibility to enable the module 120 to bend simultaneously on multiple axes to enable the construction of a curved spherical form (see FIG. 41B).

Figure 23:
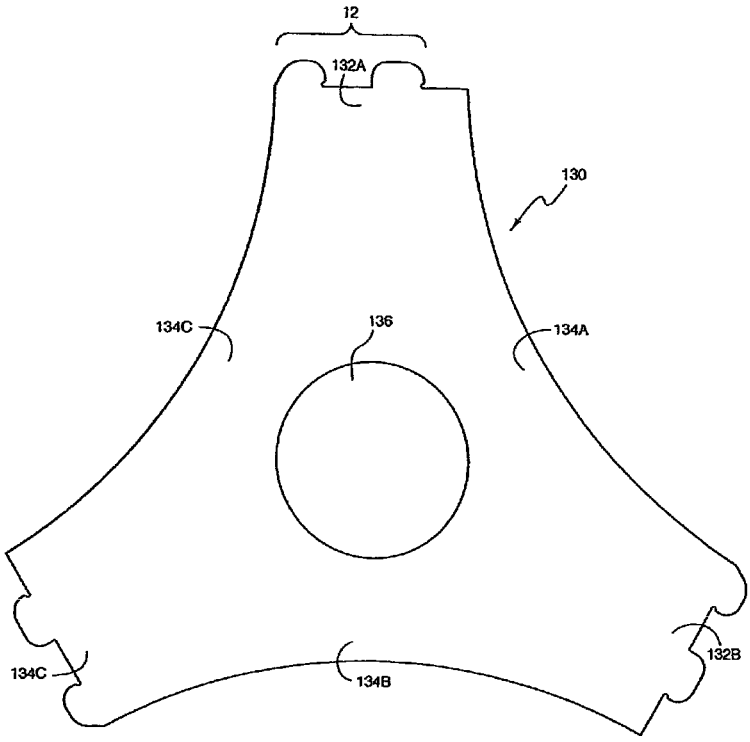
FIG. 23 illustrates a truncated triangle (dodecagon based) construction module according to an embodiment.
Figure 40C:
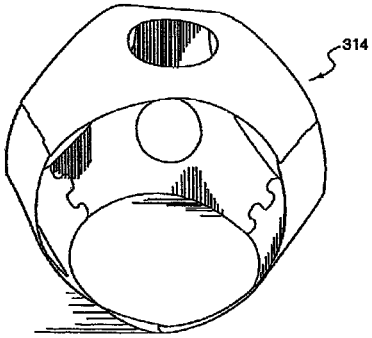
FIG. 40C illustrates a perspective view of a spherical model construction using four FIG. 40A modules according to an embodiment.

FIG. 23 shows a truncated triangle based module 130 that is formed from a 12-sided (dodecagon) polygon. The module 130 includes three straight edges 132A-C and three curved edges 134A-C. Each of the straight edges 132A-C includes the locking tab pair 12 to form three joining edges. A void 136 provides the module 130 with planar flexibility to enable the module 130 to bend on multiple axes (refer to FIGS. 40C and 40D as examples).

Figure 24:
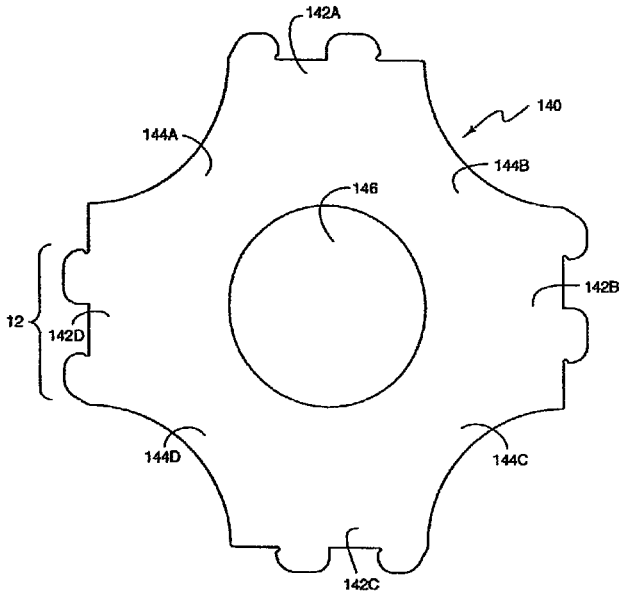
FIG. 24 illustrates a truncated octagon based construction module according to an embodiment.

FIG. 24 shows a truncated octagon based module 140 having four straight edges 142A-D and four curved edges 144A-D. Each of the straight edges 142A-D includes the locking tab pair 12 to form four joining edges. A void 146 provides the module 140 with planar flexibility as previously described (refer to FIG. 41B as an example using a plurality of modules 140).

Figure 25:
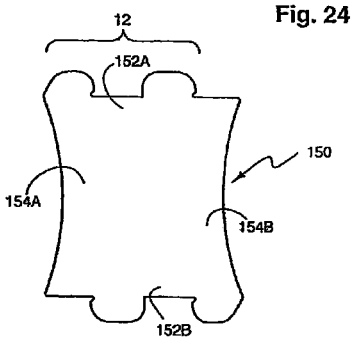
FIGS. 25 and 26 illustrate additional quadrilateral based construction modules according to various embodiments.
Figure 26:
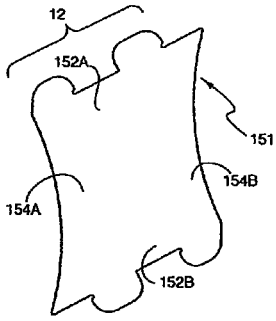

FIGS. 25 and 26 illustrate two quadrilateral based modules 150 and 151. Each module 150, 151 include two straight edges 152A and 152B and two curved edges 154A and 154B. Each of the straight edges 152A and 152B includes the locking tab pair 12 to form two joining edges.

Figure 27:
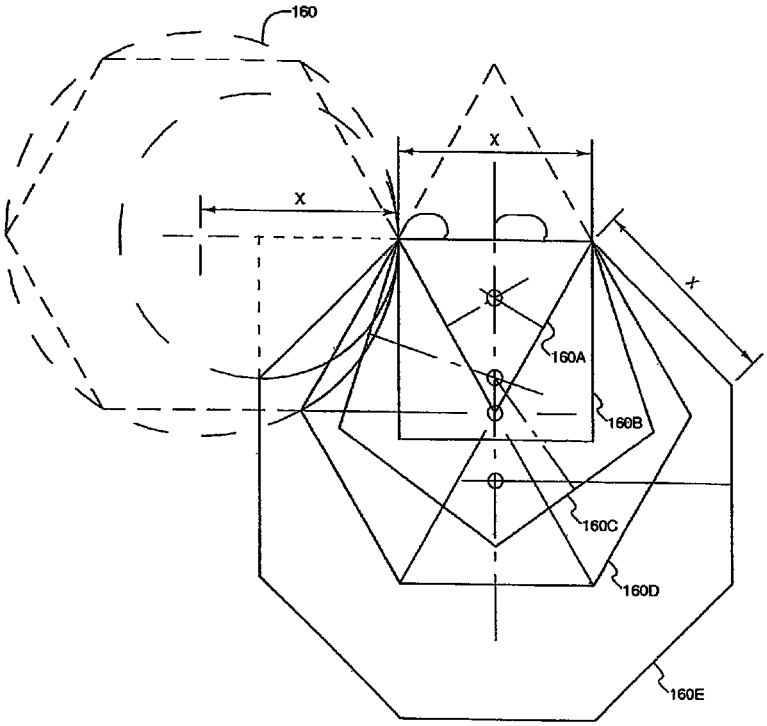
FIG. 27 illustrates a reference circle and derivative polygons that can form the basis of producing a set of construction modules according to an embodiment.
Figure 28:
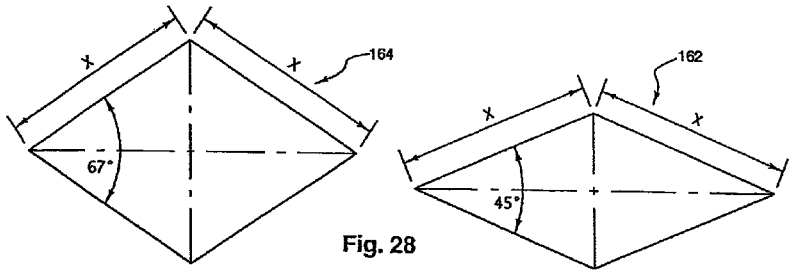
FIG. 28 illustrates the geometrical structure of two regular rhombic based modules derived from the geometry of FIG. 27.

Module Set Geometry—FIGS. 27 and 28

In one embodiment, a basic principle can be adopted to create a set of interconnectable modules as shown in FIGS. 27 and 28. In FIG. 27, a reference circle 160 having a radius X is shown that can be used as a basis to form the set of interconnectable modules. In this example, each regular polygon (triangle 160A, quadrilateral 160B, pentagon 160C, hexagon 160D, and octagon 160E) has the corresponding number of identical edge lengths X. FIG. 28 illustrates two further variants using regular rhombic polygon based modules 162 and 164 that also have the same edge lengths X. In each polygon at least two of the straight edges of length X include the locking tab pair 12. Only one locking tab pair 12 is shown in FIG. 27 to simplify the drawing.

Figure 29C:
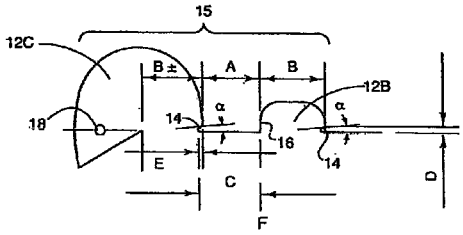

Locking Tab Pair—FIGS. 29A to 29C

As described and illustrated in the various construction modules previously referenced, each module includes at least two locking tab pairs 12 with each locking tab pair 12 being arranged on a straight edge of a module to form a joining edge. Each locking tab pair 12 includes two locking tabs 12A and 12B. An alternative locking tab pair 15 is illustrated in FIG. 29C. The locking tab pair 15 includes an extended locking tab 12C designed to accommodate a retention aperture 18, which can be used to freely hang a resulting model using a string, a hook, or the like (see FIGS. 46A to 46D). Generally, one joining edge of a construction module can include one locking tab pair 15 with the other joining edges having the usual locking tab pairs 12. FIGS. 29A to 29C illustrate geometric details of the locking tab pairs 12 and 15 according to the three embodiments.

The relationships between dimensional features designated as A, B, B±, C, D, and E shown in FIGS. 29A to 29C and 30, according to an embodiment are:

(a) $A<B$ and $A<B\pm$;

(b) $C>(A+B)/2$;

(c) $D\approx 1.5\times$ to $2.5\times$ module thickness; and (d) $E\approx 1.5\times$ to $2.5\times$ module thickness.

Letter designator F indicates a center line of a joining edge of a module. B± represents the width of tab 12A or 12C as it relates to the end of the joining edge. In other words, the width dimension B± extends from the end of the joining edge to the opening of the notch 14. Any extended portion (as in tab 12C) is not considered to be part of the tab width B± as presently defined. B± is also used to indicate that a slight dimensional variance with B is acceptable and operable.

The notches 14 are sloped at the notch angle $\alpha$ at a leading side based on desired release resistance of joined modules. The notch angle $\alpha$ can range from approximately 0 degrees to approximately 30 degrees. As the notch angle $\alpha$ is reduced the force to disengage pairs of engaged locking tabs increases. FIG. 29A illustrates notch angles $\alpha$ of approximately 30 degrees and FIG. 29B illustrates notch angles $\alpha$ of approximately 10 degrees. Where softer materials (such as paper stock) are used to construct the modules and where a stronger holding force is desired a notch angle $\alpha$ of approximately 15 degrees is appropriate.

The construction modules can be made from a flexible material such as paper card stock, thin sheets of plastic, and thin metal plates. For example, a useful module for geometric modeling can have a thickness of 0.010" to 0.030" (0.25 mm to 0.76 mm) and a straight edge/joining edge length of between 1.625" to 3.25" (41.3 mm to 82.5 mm). Larger modules, suitable for point-of-sale displays, can be made from thicker materials ranging from 0.12" to 0.375" (3 mm to 9.5 mm) with a straight edge/joining edge length of 12" to 48" (30.5 cm to 121.9 cm).

More generally, construction modules can have a ratio of thickness over straight edge/joining edge length of 0.006 to 0.012.

Figure 30:
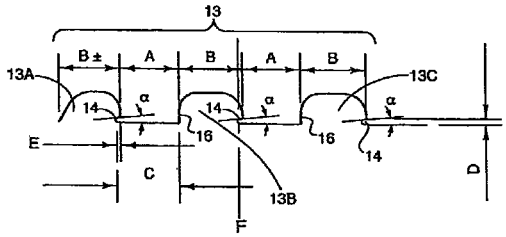
FIG. 30 illustrates a three-tab locking configuration for construction modules according to another embodiment.

Triple Locking Tab—FIG. 30

FIG. 30 shows a triple locking tab 13 having three tabs 13A, 13B and 13C. The triple locking tab 13 can be used for larger scale modules and constructions (as discussed above in connection with point-of-sale displays). The geometric relationship between features A to F and notch angles $\alpha$ are the same as previously described in conjunction with FIGS. 29A and B.

Flexible Hinge & Stiffening Plane—FIGS. 31 and 32A-C

Figure 31:
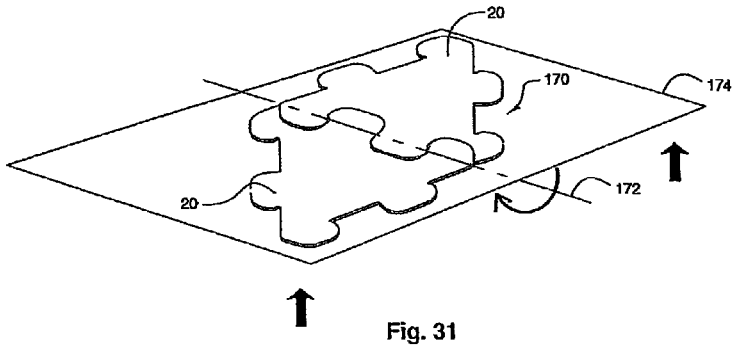
FIG. 31 illustrates a flexible hinge and a stiffening plane that is established from two joined construction modules according to an embodiment.
Figure 32A:
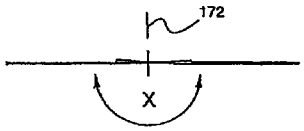
FIG. 32A illustrates the maximum articulated angle (or dihedral angle) of the hinge of the joined construction modules of FIG. 31.
Figure 32B:
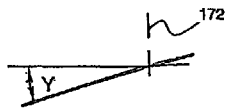
FIG. 32B illustrates a minimum articulated angle (or dihedral angle) of the hinge of the joined construction modules of FIG. 31.

FIG. 31 illustrates two triangular based modules 20 attached at joining edges to form an assembled construction 170. The construction 170 forms a flexible hinge defined about an axis 172 having a wide operating range. FIG. 32A illustrates a maximum articulation/dihedral angle X of approximately 180 degrees. FIG. 32B illustrates a minimum articulation/dihedral angle Y of approximately 10 degrees. At the maximum angle X the locking tab pair of each module 20 interacts with each other to stiffen the construction 170. The direction of a stiffening plane 174 can be controlled by the choice of alignment of the locking tabs either above or below the mated module (detailed further in FIGS. 33C and 33E).

Figure 32C:
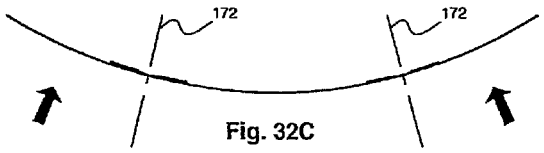
FIG. 32C illustrates a result of bending the stiffening plane to enable the construction of uniform curvatures from multiple joined modules.

The ability to apply the stiffening plane 174 to a construction is useful when assembling models having larger compound faces composed of multiple parts joined together (see FIG. 44 as an example). The interaction of locking tab pairs forms an integral plane between two joined modules allowing a bending moment to be displaced along the joined modules. This hinge structure enables the creation of curved spherical geometry (see FIG. 41B as an example). The locking tab geometry and engagement is effective when under the tension of a curved form as illustrated in FIG. 32C. FIG. 32C illustrates the effect of bending the stiffening plane 174 created by the connection of construction modules to enable the creation of a uniform curvature. In particular, the locking tabs 12A (or 12C) and 12B of joined modules reacting against one another create a continuous plane that will deform uniformly to a curve. The feature enable construction of spherical structures as shown in FIGS. 39D, 40C, 40D and 41B.

Joining Modules—FIGS. 33A to 33J

Figure 33A:
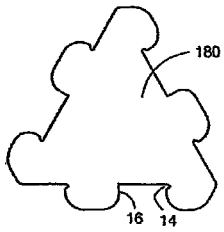
FIGS. 33A to 33E illustrate joining two construction modules with illustrative stiffening planes.
Figure 33C:
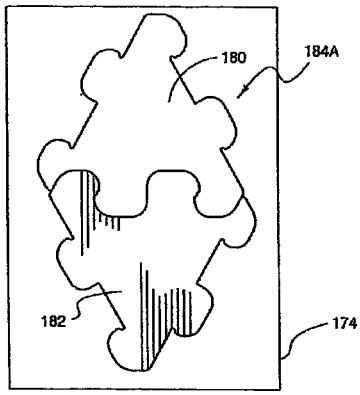
Figure 33B:
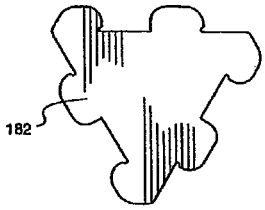
Figure 33E:
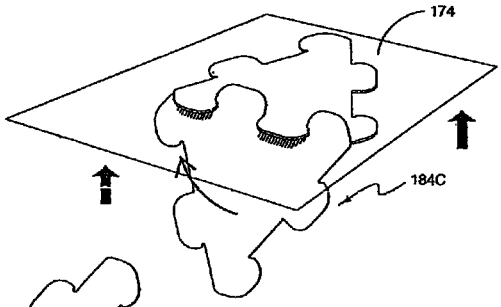
Figure 33D:
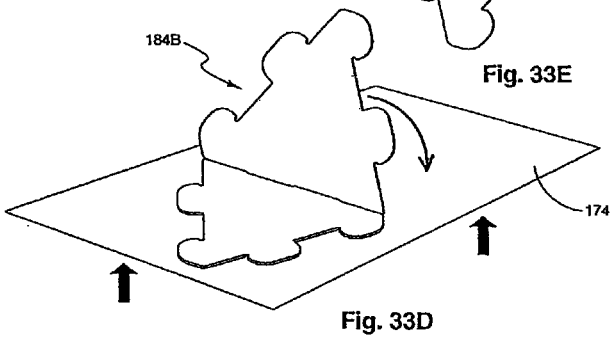
Figure 33F:
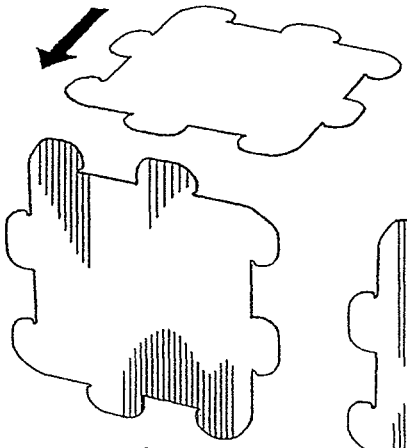
FIGS. 33F to 33J illustrate a method of joining two construction modules according to various embodiments.
Figure 33G:
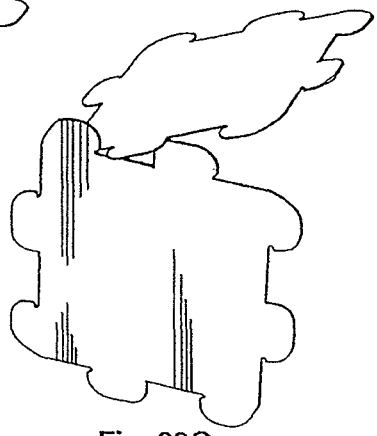
Figure 33H:
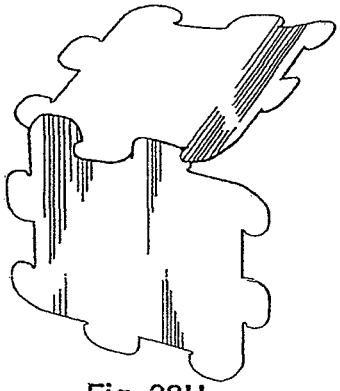

Module 180 (FIG. 33A) is releasable connected to module 182 (FIG. 33B) by engaging the notches from a locking tab pair of one module with the notches from a locking tab pair of another module. Various views of the resulting joined pair of modules 184A, 184B and 184C are shown in FIGS. 33C, 33D and 33E, respectively.

In general, the modules 180 and 182 are secured by structural interference established between engaged locking tab pairs and in particular, between mating of the notches of joined locking tabs. The flexibility of the material used to construct the modules enables the locking tabs to deflect or bend while being engaged. One side of a paired joint is a straight edge perpendicular to the stiffening plane 174 (see FIG. 33D); the second side of the paired joint has a radius or sloping edge acting as an inclined plane to gradually deflect the joined modules (see FIG. 33E). Once fully engaged the modules relax and the two notches of the locking tabs act against one another. The straight portion 16 of tab 12B on the opposite side of the notch 14 of tab 12A maintains the position of the modules on the notches.

Figure 33I:
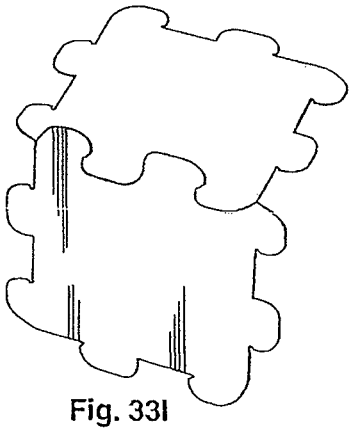
Figure 33J:
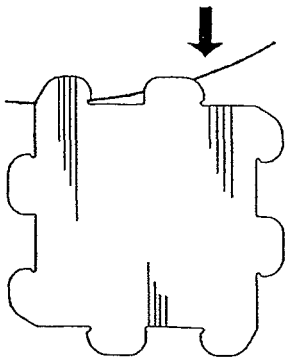

Referring to FIGS. 33F to 33J, one way to join two modules is to move two joining edges toward each other (FIG. 33F), hook one locking tab into the notch of another (FIG. 33G), then press the second locking tab into place (FIGS. 33H and 33J) to produce a joined pair of modules (FIG. 33I).

Three-Way Connection—FIGS. 34A-34D

Figure 34A:
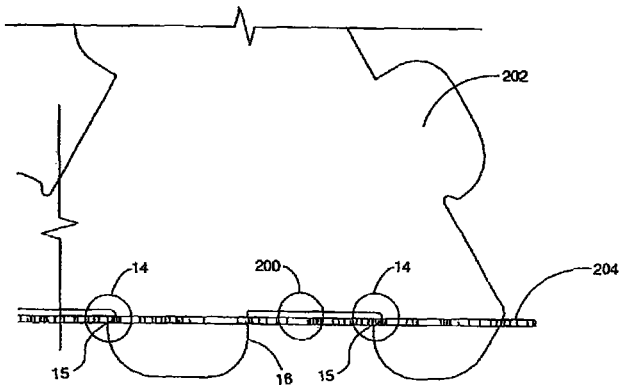
FIGS. 34A to 34D illustrate a three-way construction module connection according to an embodiment.
Figure 34B:
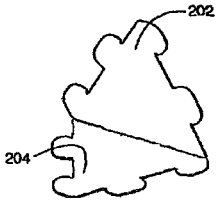
Figure 34C:
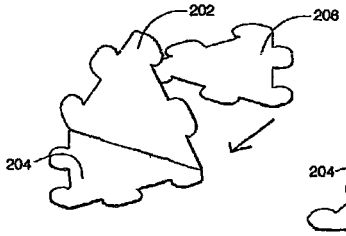
Figure 34D:
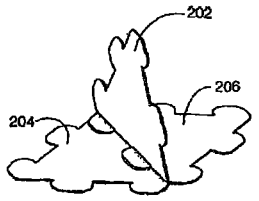

As previously discussed, each locking tab 12A and 12B includes a notch 14 having an angled sloping portion 15. FIG. 34A illustrates a gap 200 that is formed when two modules 202 and 204 are joined and oriented roughly perpendicular to each other. The gap 200 provides a space sufficient to receive locking tabs of a third module 206 oriented along the same plane as module 204 as shown in FIG. 34C to form a three-way interlock as shown in FIG. 34D.

Crease-Lines—FIGS. 35A to 35D

Figure 35A:
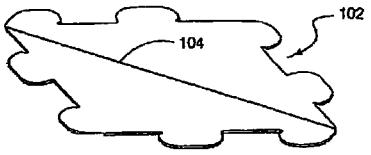
FIGS. 35A to 35D illustrate a construction module with a crease-line and various constructions using such modules according to embodiments.
Figure 35B:
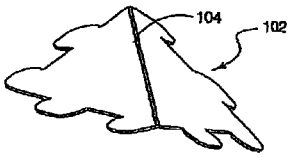
Figure 35C:
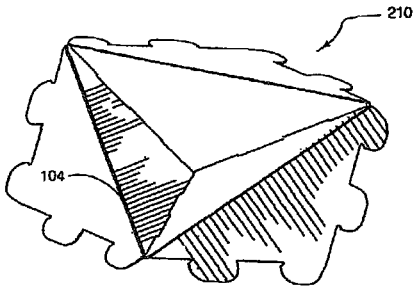
Figure 35D:
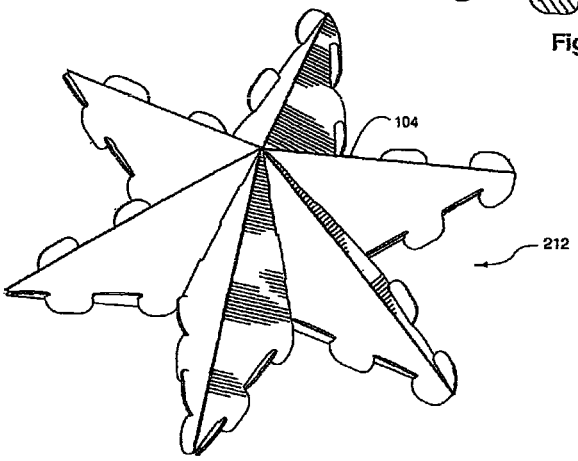

FIG. 35A illustrates a wide rhombus construction module 102 having a straight crease-line 104 to increase flexibility for enabling bending of the module 102, as shown in FIG. 35B, to assist in the construction of three-dimensional constructions. For example, FIG. 35C illustrates an assembly 210 of three wide rhombus modules 102 folded on their respective crease-lines 104 to make a dimpled hexagonal. FIG. 35D illustrates an assembly 212 using a plurality of wide rhombus modules 102 folded on their respective crease-lines 104 to make a six pointed star form.

Figures 36A, 36B, 36C:
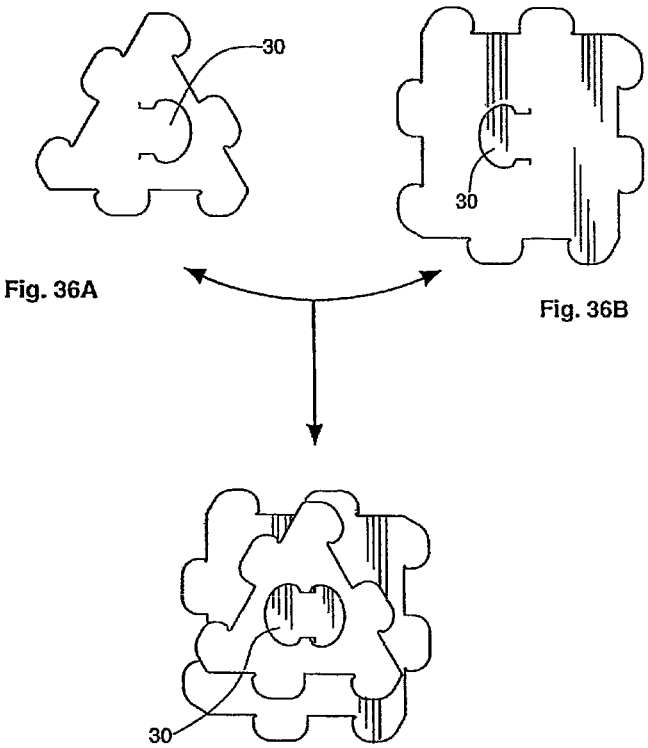
FIGS. 36A to 36C illustrate face-to-face connection between a triangle and square construction module according to an embodiment.

Face-To-Face Connection—FIGS. 36A to 36C

FIGS. 36A and 36B illustrate two modules having the flexible tab 30 located in the center portion of the module. Two modules with center tabs 30 can be joined by engaging the tab of the modules into the reciprocal slot opening of the other module (the slot opening being revealed when the tab is turned up). This creates a face-to-face connection as illustrated in FIG. 36C.

Surface Mounting—FIGS. 37A to 37D

Figure 37A:
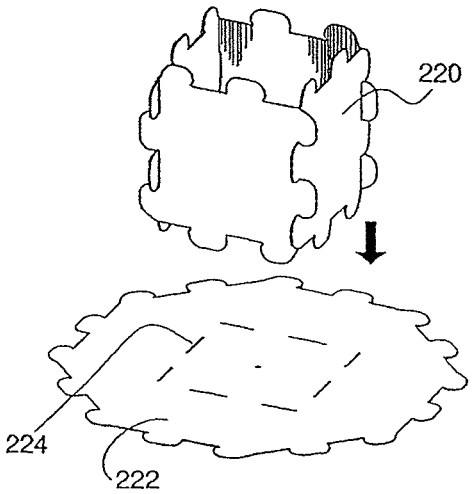
FIGS. 37A to 37D illustrate slot-based module constructions according to various embodiments.
Figure 37C:
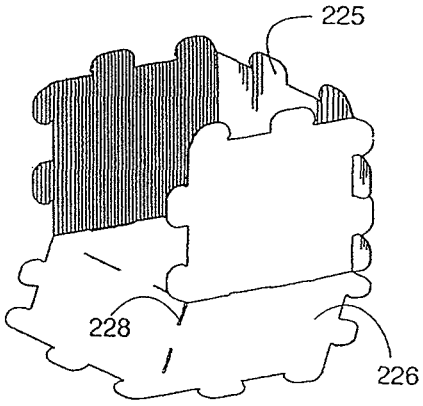
Figure 37B:
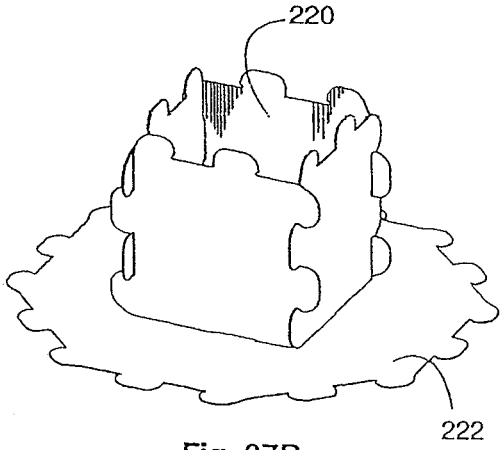
Figure 37D:
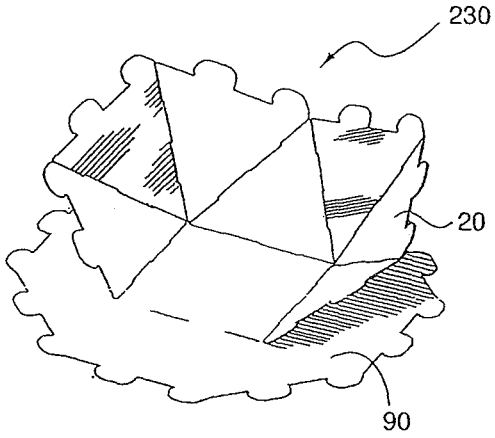

FIG. 37A illustrates a four module set 220 aligned above an octagon based module 222 having a plurality of slots 224 arranged in a square based formation. FIG. 37B illustrates the set 220 as assembled to the module 222. FIG. 37C illustrates a three module set 225 assembled to a hexagon based module 226, which also has a plurality of slots 228 but are arranged in a diagonal based orientation. FIG. 37D illustrates a seven module set 230 (using a plurality of triangle based modules 20) connected to a slotted octagon based module 90 arranged at an angle less than 90 degrees.

Three-Dimensional Constructions—FIGS. 38A to 41B

Figure 38A:
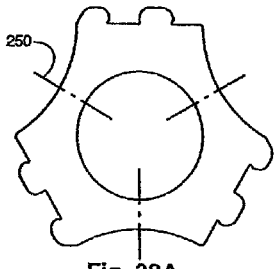
FIGS. 38A to 38E illustrate various truncated constructions modules with illustrated bending axes according to various embodiments.
Figure 38B:
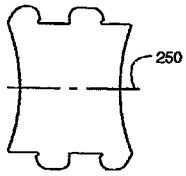
Figure 38C:
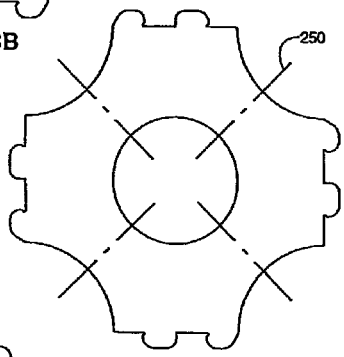
Figure 38D:
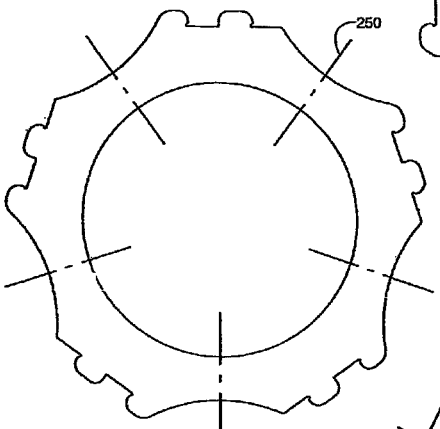
Figure 38E:
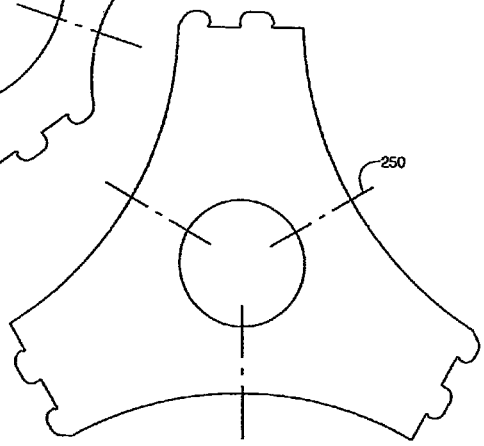

When modules are connected in a curved or spherical structure tension is created at the joint reinforcing the locking engagement of the locking tabs. FIGS. 38A to 38E illustrate a number of modules (all previously described) that are suitable for creating complex models with compound curvatures. At least one (see FIG. 38B) and as many as five (see FIG. 38D) bending axes 250 are shown on the illustrated modules. Each bending axis 250 enables bending in a plane of the module. For example, the truncated triangle of FIG. 38E shows three bending axes 250 that enable the module to bend in three planes.

Figure 39C:
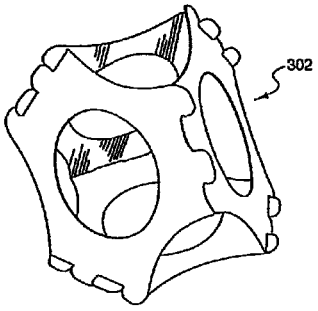
FIG. 39C illustrates a perspective view of a facetted model construction using four FIG. 39A modules according to an embodiment.
Figure 39D:
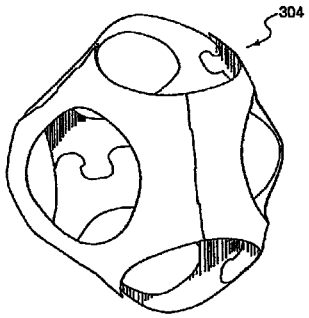
FIG. 39D illustrates a perspective view of a spherical model construction using four FIG. 39A modules according to an embodiment.
Figure 39A:
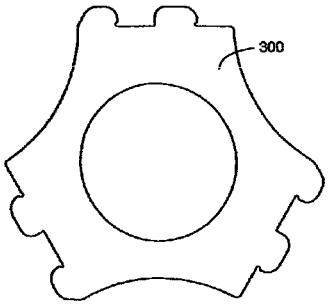
FIGS. 39A and 39B illustrate a plan view and a perspective view of a flexed truncated hexagon based construction module according to an embodiment.
Figure 39B:
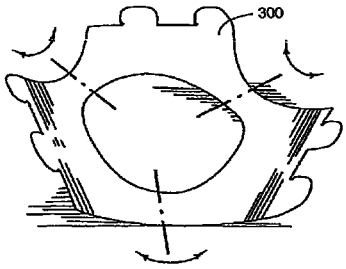

FIGS. 39A and 39B illustrate a plan view and a perspective view of a truncated hexagon module 300. Four modules 300 are joined to produce a facetted model construction 302 as shown in FIG. 39C and a spherical model construction 304 as shown in FIG. 39D.

Figure 40D:
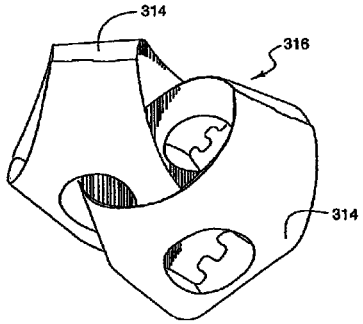
FIG. 40D illustrates a perspective view of an interconnected spherical model construction using the FIG. 40A modules according to an embodiment.
Figure 40B:
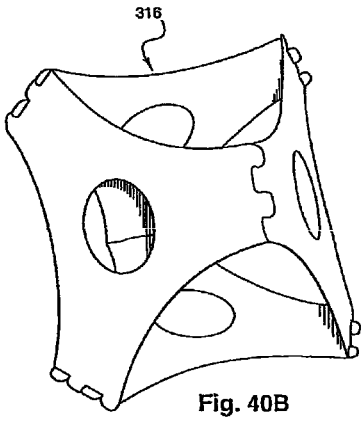
FIG. 40B illustrates a perspective view of a facetted model construction using four FIG. 40A modules according to an embodiment.
Figure 40A:
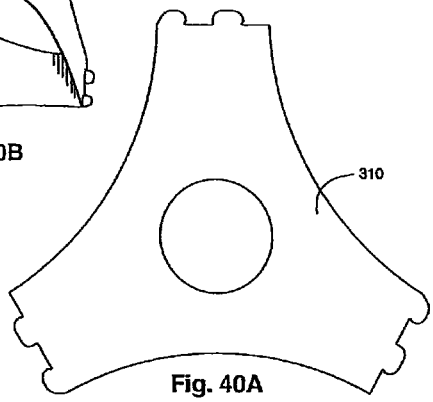
FIG. 40A illustrates a plan view of a truncated triangle based module according to an embodiment.

FIG. 40A illustrates a plan view of a truncated triangle module 310. Four modules 310 are joined to produce a facetted model construction 312 as shown in FIG. 40B and a spherical model construction 314 shown in FIG. 40C. FIG. 40D illustrates a perspective view of an interconnected spherical model construction 316 with a continuous surface using two interlaced constructions 314.

Figure 41A:
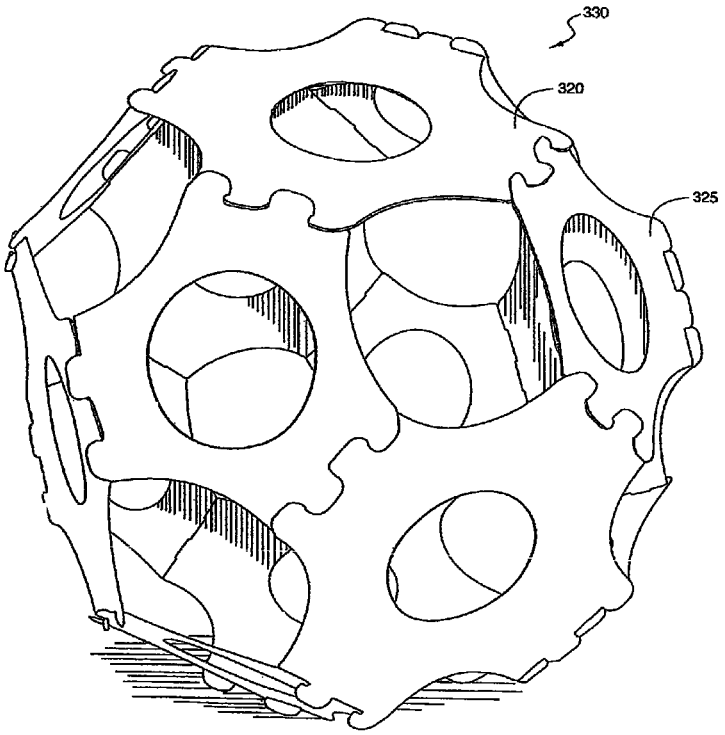
FIGS. 41A and 41B illustrate a facetted and spherical model construction, respectively, using a plurality of truncated hexagon and octagon based modules according to an embodiment.
Figure 41B:
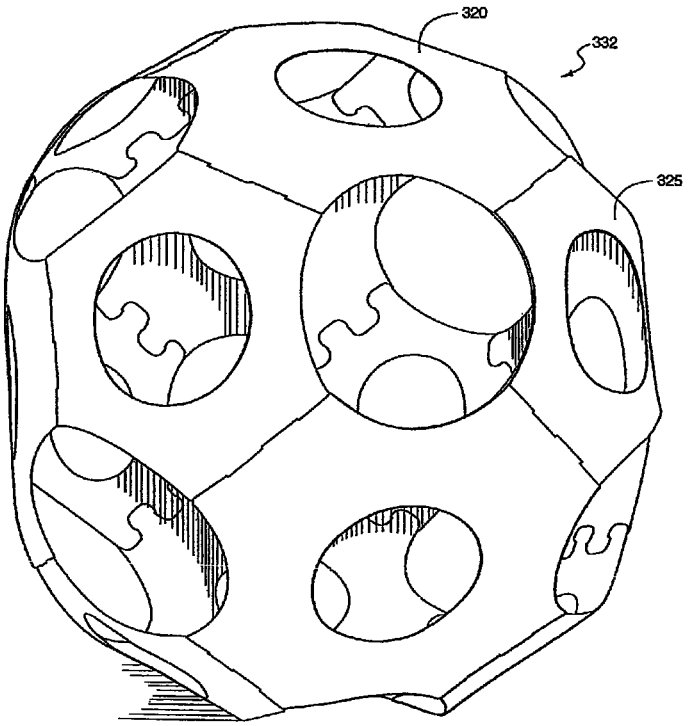

FIGS. 41A and 41B illustrate a facetted 330 and a spherical model construction 332, respectively, using a plurality of truncated octagon modules 320 in combination with a plurality of truncated hexagon based modules 325.

Figure 42:
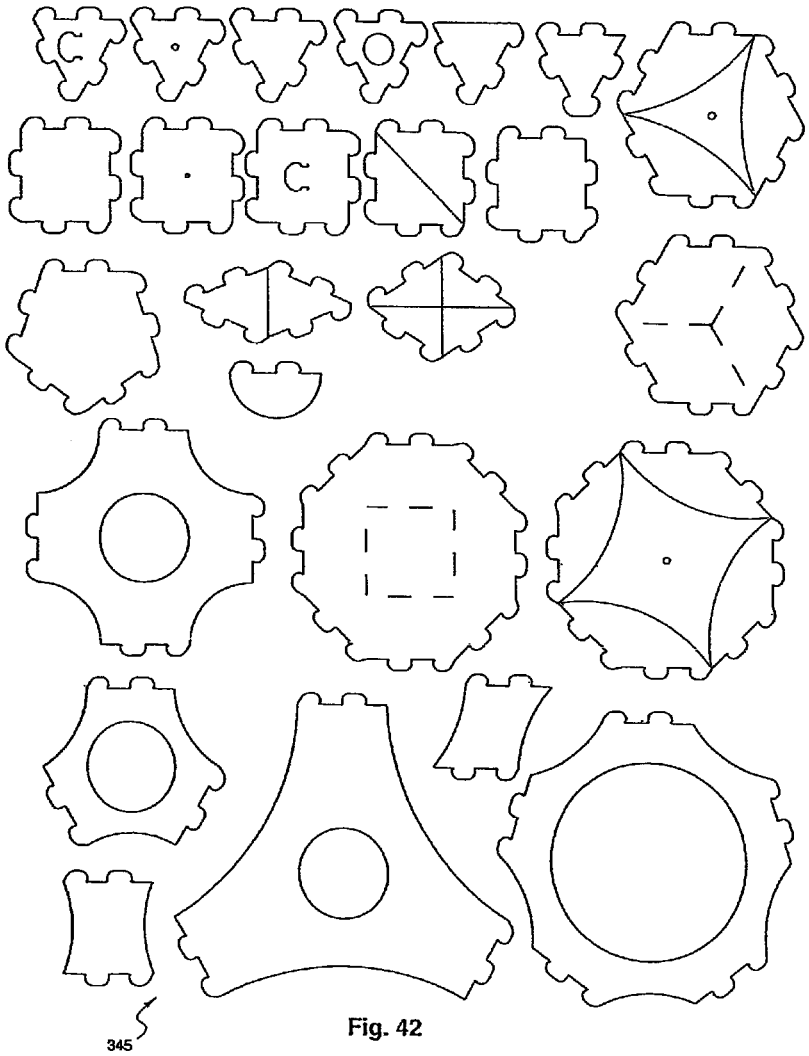
FIG. 42 illustrates a kit including a plurality of mixed construction modules as previously described.

Kit—FIG. 42

FIG. 42 illustrates a sample kit 345 that includes a plurality of mixed type modules as previously described. The modules in the kit 345 can be used to freely make a number of different constructions. From an educational perspective the modules can be used to construct regular polyhedral and semi-regular polyhedral. From a toy perspective the modules can be used to make any number of creative models.

Figure 43B:
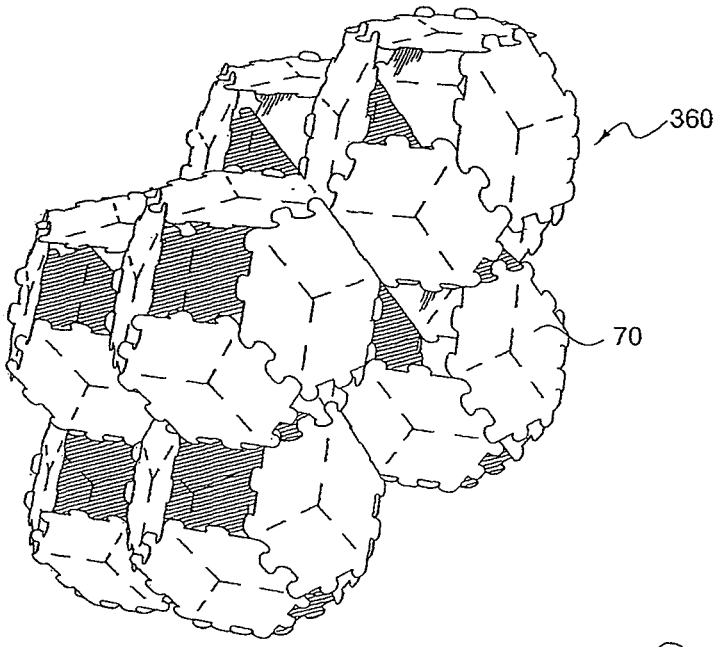
FIG. 43B illustrates a plurality of truncated octahedrons constructed with hexagon based modules connected at common faces to form a closed packed array according to an embodiment.
Figure 43A:
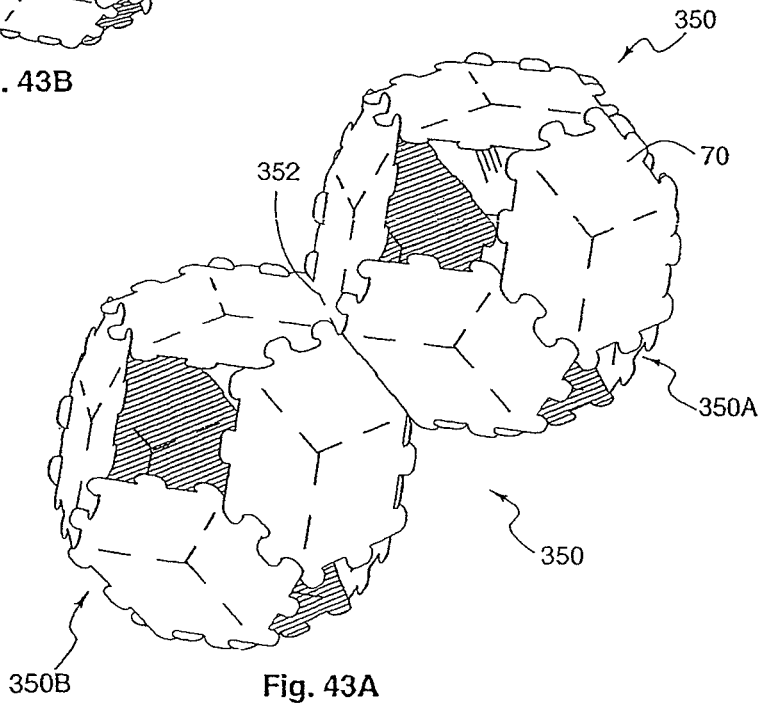
FIG. 43A illustrates two truncated octahedrons constructed with hexagon based modules connected at a common face according to an embodiment.

Closed-Packed Constructions—FIGS. 43A-43B

FIG. 43A illustrates a three dimensional closed packed construction 350 using a plurality of hexagon based modules 70. The construction 350 consists of two truncated octahedron assemblies 350A and 350B connected by a locking tab pair 12 along a common plane 352. FIG. 43B illustrates another three dimensional closed packing construction 360 also using a plurality of hexagon based modules 70. The construction 360 consists of a plurality of assembled octagon based constructions nested together.

Figure 44A:
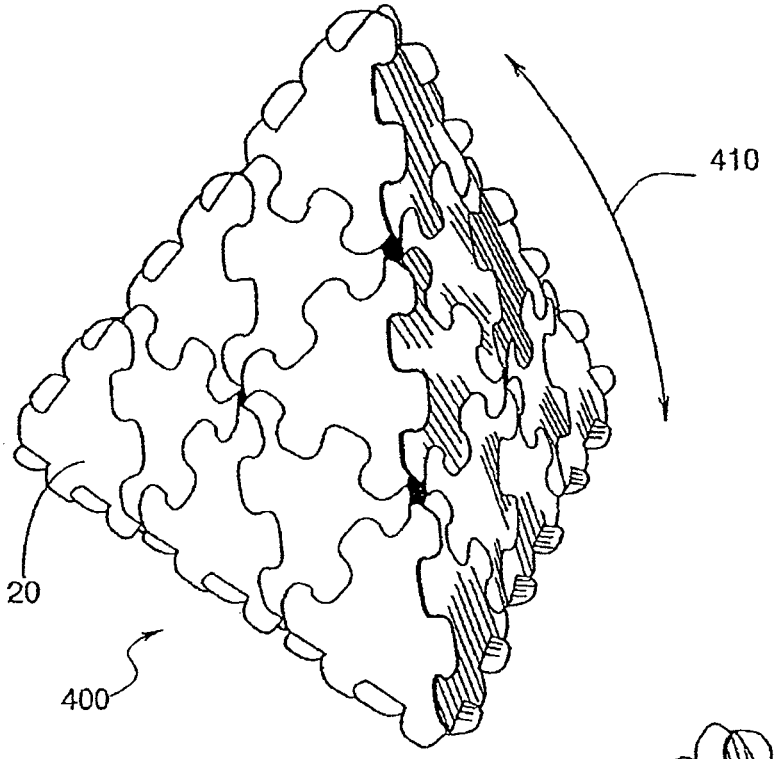
FIGS. 44A and 44B illustrate pyramidal based constructions having curved surfaces according to various embodiments.
Figure 44B:
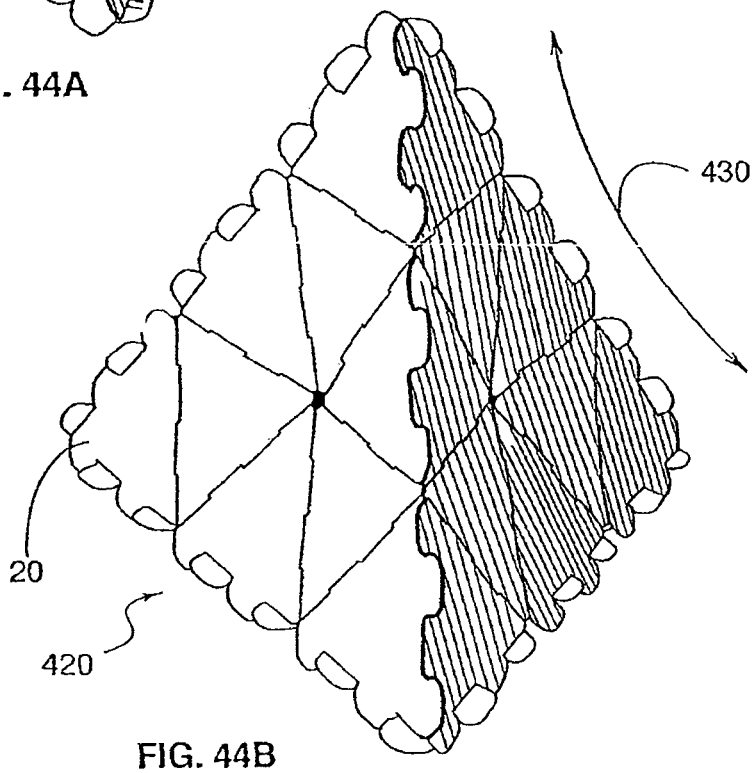

Curved Constructions—FIGS. 44A-44B

FIG. 44A illustrates a pyramidal construction 400 using a plurality of triangle based modules 20. Curved line 410 indicates a convex surface formed on the construction 400.

FIG. 44B illustrates a pyramidal construction 420 using a plurality of triangle based modules 20. Curved line 430 indicates a concave surface formed on the construction 420.

Figure 45A:
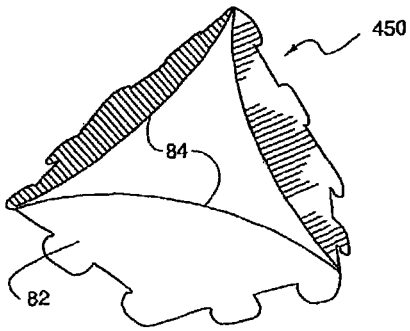
FIGS. 45A to 45C illustrate a hexagon based module having crease-lines and various constructions using such modules according to embodiments.
Figure 45B:
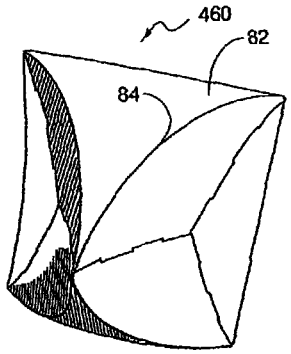
Figure 45C:
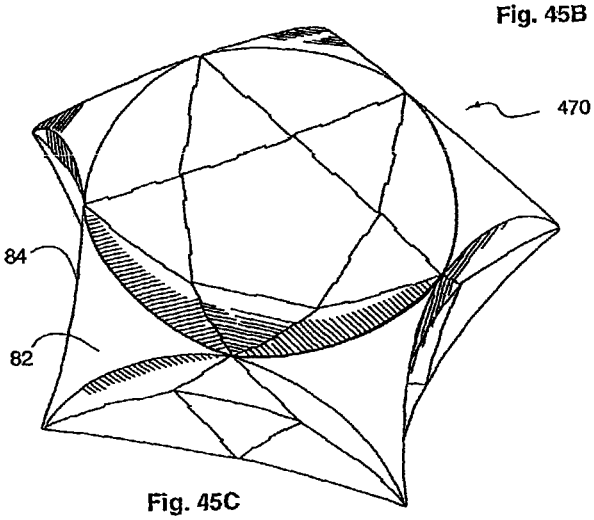

Curved Constructions Using Creased Hexagons—FIGS. 45A-45C

FIG. 45A illustrates the hexagon based module 82 folded along curved crease-lines 84 creating a three-dimensional form 450 having compound curvature. FIG. 45B illustrates a curved octahedral form 460 constructed from four folded hexagons 82. FIG. 45C illustrates a pentagonal star form made from a plurality of folded modules including ten hexagons 82.

Decorative Voids and Extended Locking Tab—FIGS. 46A-D

Figure 46A:
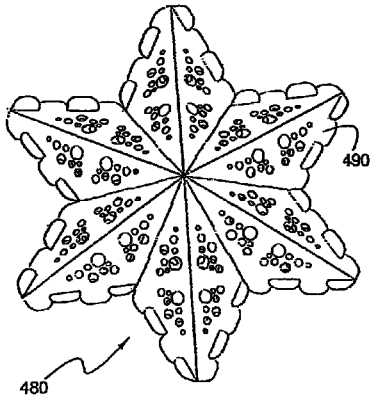
FIG. 46A illustrates a star shaped model.
Figure 46B:
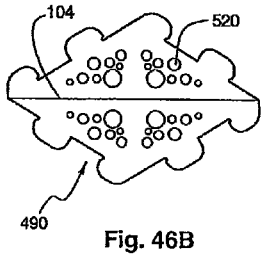
FIG. 46B illustrates a rhombus based module having a plurality of decorative voids used to construct the model of FIG. 46A.

FIG. 46A illustrates a star shaped construction 480 using a plurality of rhombus based modules 490 (individually shown in FIG. 46B). The module 490 includes a plurality of circular decorative voids 520 to add a design feature to the construction module.

Figure 46C:
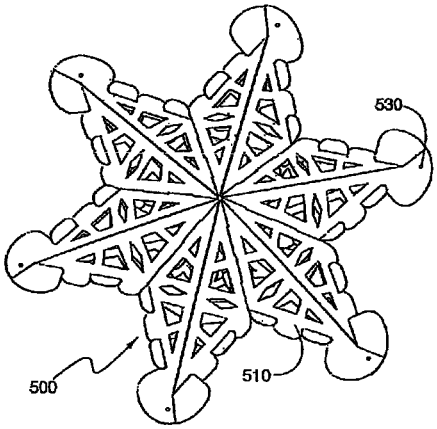
FIG. 46C illustrates a star shaped model.
Figure 46D:
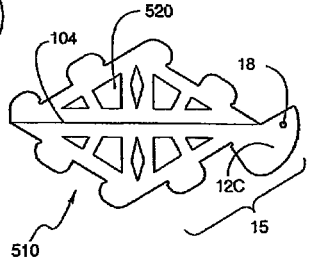
FIG. 46D illustrates a rhombus based module having a plurality of decorative voids and an extended locking tab used to construct the model of FIG. 46C.

FIG. 46C illustrates a star shaped construction 500 using a plurality of rhombus based modules 510 (individually shown in FIG. 46D). The module 510 includes a plurality of angular polygon type decorative voids 522 to add a design feature to the construction module. Both modules 490 and 510 include one locking tab pair 15 that includes the extended locking tab 12C having the retention aperture 18 to enable the receipt of a string, wire, and the like for hanging the construction 500.

Figure 47:
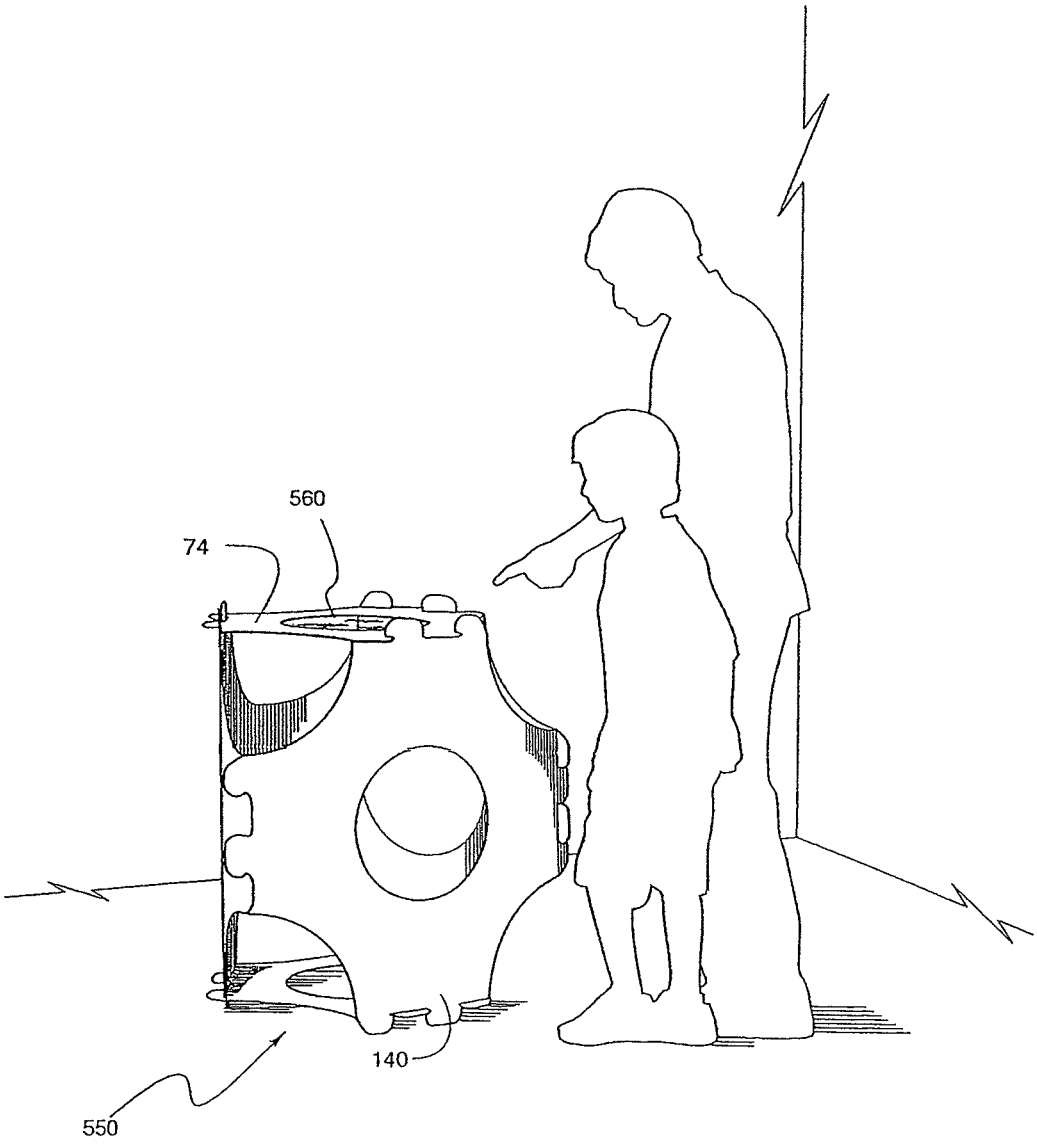
FIG. 47 illustrates a construction suitable for point-of-sale use made using large scale construction modules.

Point of Sale/Purchase Displays—FIG. 47

FIG. 47 illustrates a large scale construction 550 assembled from various modules (74. 140) that is used as a point-of-sale/purchase display. The construction 550 includes three truncated octahedron based modules 140 and two truncated hexagon based modules 74. The upper module 74 includes a transparent plastic sheet 560 overlaying the center void to form a display surface. The modules used in construction 550 have an overall dimension (measured across the parallel edges) of approximately 32" (81.3 cm) with a straight edge length of approximately 13" (33 cm) and a thickness of 0.12" to 0.16" (3 mm to 4 mm). As previously discussed, construction modules suitable for large scale constructions can be made with PVC sheeting having a foamed core or with Coroplast™ sheeting have hollow sections.

The invention claimed is:

1. A geometric construction module formed from a substantially flat, flexible material, the module comprising:

a. a polygon based shape having two straight edges; and b. a locking tab pair integral with each one of the straight edges to form joining edges, each locking tab of the locking tab pair having a notch at the straight edge, the notches of each locking tab pair being symmetrical about a center line of the joining edge;

wherein the module is 0.010" to 0.030" (0.25 mm to 0.76 mm) thick and has a ratio of module thickness to joining edge length of between 0.006 to 0.012.

2. The geometric construction module of claim 1, wherein one of the locking tabs includes an edge portion perpendicular to the joining edge and opposite to the notch of the other locking tab in the locking tab pair.

3. The geometric construction module of claim 1, wherein each notch of each locking tab is sloped with respect to the joining edge at an angle of 0 to 30 degrees.

4. The geometric construction module of claim 1, further comprising a third locking tab, with the locking tabs being equally spaced along each joining edge.

5. The geometric construction module of claim 1, wherein the joining edges of each module are equal in length.

6. The geometric construction module of claim 1, wherein the module includes a center void for providing a bending axis in respect of a plane of the module.

7. The geometric construction module of claim 1, wherein the module includes a straight or curved crease line to form a bending plan in the module.

8. The geometric construction module of claim 1, wherein the polygon based shape of the module is selected from the group consisting of: (i) a triangle with three joining edges; (ii) a triangle with two joining edges and one straight edge; (ii) a quadrilateral with four joining edges; (iii) a quadrilateral with two joining edges and two curved edges; (iv) a pentagon with five joining edges; (v) a hexagon with six joining edges; (vi) an octagon with eight joining edges; (vii) a truncated hexagon with three joining edges and three curved edges and a center void; (viii) a truncated decagon with five joining edges and five curved edges and a center void; (ix) a truncated dodecagon with three joining edges and three curved edges and a center void; and (x) a truncated octagon with four joining edges and four curved edges and a center void.

9. A geometric construction module formed from a substantially flat, flexible material, the module comprising:

a. a polygon based shape having two straight edges; and b. a locking tab pair integral with each one of the straight edges to form joining edges, each locking tab of the locking tab pair having a notch at the straight edge, the notches of each locking tab pair being symmetrical about a center line of the joining edge;

wherein one locking tab of the locking tab pair is an extended tab that includes a portion extending beyond the end of the joining edge and above the other locking tab in the locking tab pair.

10. A geometric construction module formed from a substantially flat, flexible material, the module comprising:

a. a polygon based shape having two straight edges; and b. a locking tab pair integral with each one of the straight edges to form joining edges, each locking tab of the locking tab pair having a notch at the straight edge, the notches of each locking tab pair being symmetrical about a center line of the joining edge;

wherein one of the locking tabs includes an edge portion perpendicular to the joining edge and opposite to the notch of the other locking tab in the locking tab pair; and wherein A is less than B, A is less than B±, C is greater than the sum of A and B divided by two; and D and E are between 1.5 times and 2.5 times module thickness; where A represents locking tab spacing in the locking tab pair, B represents width of one locking tab, B± represents width of the other paired locking tab, C represents space between the edge portion of one locking tab and the notch of the other paired locking tab, D represents notch height, E represents notch width and where B is approximately equal to B±.

11. A geometric construction module formed from a substantially flat, flexible material, the module comprising:

a. a polygon based shape having two straight edges; and b. a locking tab pair integral with each one of the straight edges to form joining edges, each locking tab of the locking tab pair having a notch at the straight edge, the notches of each locking tab pair being symmetrical about a center line of the joining edge;

wherein the module is 0.12" to 0.375" (3 mm to 9.5 mm) thick and has a ratio of module thickness to joining edge length of 0.006 to 0.012.

12. A geometric construction system comprising a plurality of substantially flat, flexible modules, each module comprising:

a. a polygon based shape having at least two straight edges, at least two curved edges and a center void for providing a bending axis in respect of a plane of the module; and b. a locking tab pair at each of the straight edges to form joining edges, one of the locking tab pairs of a first module from the plurality of modules being releasably engageable with one of the locking tab pairs of a second module from the plurality of modules to establish a flexible hinge imparting planar stiffening between the joined first and second modules for enabling construction of a model having compound curves;

wherein at least two of the plurality of modules include a centered flexible tab for enabling face-to-face connection of the least two modules.

13. The geometric construction system of claim 12, wherein the flexible hinge has a dihedral operating range of 10 to 180 degrees.

14. The geometric construction systems of claim 12, wherein one of the plurality of modules include slots for receiving locking tabs from at least one of the plurality of modules.

15. The geometric construction systems of claim 12, wherein two perpendicularly joined modules form a gap for receiving locking tabs of a third module to form a three way connection.

16. The geometric construction system of claim 12, wherein the plurality of modules are a selection of a set of modules from the group consisting of (i) module with two straight edges and two curved edges; (ii) module with three straight edges and three curved edges; (iii) module with four straight edges and four curved edges; and (iv) module with five straight edges and five curved edges.

* * * * *